US011092039B2

(12) United States Patent
Kolvick et al.

(10) Patent No.: US 11,092,039 B2
(45) Date of Patent: Aug. 17, 2021

(54) APPARATUS FOR CIRCUMFERENTIAL SEPARATION OF TURBINE BLADES

(71) Applicant: General Electric Company, Schenectady, NY (US)

(72) Inventors: Sandra Beverly Kolvick, Simpsonville, SC (US); Kevin Leon Bruce, Greer, SC (US); Antoine Mastroianni, Bourogne (FR); Danielle Werner, Esko, MN (US); Hubert Karol Wojtowicz, Warsaw (PL)

(73) Assignee: General Electric Company, Schenectady, NY (US)

( * ) Notice: Subject to any disclaimer, the term of this patent is extended or adjusted under 35 U.S.C. 154(b) by 314 days.

(21) Appl. No.: 15/723,254

(22) Filed: Oct. 3, 2017

(65) Prior Publication Data

US 2019/0101012 A1 Apr. 4, 2019
US 2020/0191003 A9 Jun. 18, 2020

(30) Foreign Application Priority Data

Oct. 27, 2016 (PL) ..... 419272

(51) Int. Cl.
*F01D 25/28* (2006.01)
*B25B 5/00* (2006.01)
(Continued)

(52) U.S. Cl.
CPC ..... *F01D 25/285* (2013.01); *B25B 5/003* (2013.01); *B25B 5/101* (2013.01); *B25B 27/14* (2013.01);
(Continued)

(58) Field of Classification Search
CPC ..... F05D 2230/64; F05D 2230/642; F05D 2230/644; F05D 2230/68; F01D 5/005;
(Continued)

(56) References Cited

U.S. PATENT DOCUMENTS 5,183,244 A 2/1993 Ortolano et al.
5,649,618 A * 7/1997 Tetzloff ..... B25B 1/103 198/687.1
(Continued)

FOREIGN PATENT DOCUMENTS

EP 2 354 456 A2 8/2011

OTHER PUBLICATIONS

Extended European Search Report and Opinion issued in connection with corresponding EP Application No. 17198843.9 dated Mar. 7, 2018.

*Primary Examiner* — Christopher J Besler
(74) *Attorney, Agent, or Firm* — James Pemrick; Hoffman Warnick LLC

(57) ABSTRACT

Embodiments of the present disclosure can provide an apparatus for circumferentially separating turbine blades. An apparatus according to the present disclosure may include: a length-adjustable elongate member having opposing first and second ends; a first clasp coupled to the first end of the length-adjustable elongate member, the first clasp shaped to at least partially engage an airfoil profile of a first turbine blade positioned circumferentially adjacent to a dovetail slot, relative to a centerline axis of the turbomachine; and a second clasp coupled to the second end of the length-adjustable elongate member, the second clasp shaped to at least partially engage an airfoil profile of a second turbine blade circumferentially positioned adjacent to the dovetail slot, the first and second turbine blades being circumferentially adjacent to the dovetail slot at opposing circumferential ends thereof.

7 Claims, 7 Drawing Sheets

(51) Int. Cl.

| | |
|---|---|
| ***B25B 5/10*** | (2006.01) |
| ***B25B 27/14*** | (2006.01) |
| *F01D 5/12* | (2006.01) |
| *F01D 5/30* | (2006.01) |

(52) U.S. Cl.
CPC ..... *F01D 5/12* (2013.01); *F01D 5/3007* (2013.01); *F05D 2230/64* (2013.01); *F05D 2230/68* (2013.01); *F05D 2230/70* (2013.01)

(58) Field of Classification Search
CPC ..... F01D 25/28; F01D 25/285; B25B 5/003; B25B 5/101; B25B 27/14
See application file for complete search history.

(56) References Cited

U.S. PATENT DOCUMENTS

| | | | | |
|---|---|---|---|---|
| 7,353,588 | B2 | 4/2008 | Crain et al. | |
| 8,046,886 | B2 | 11/2011 | DeMania et al. | |
| 2004/0107554 | A1 | 6/2004 | McGee et al. | |
| 2011/0178727 | A1* | 7/2011 | Hafenrichter ..... | F01D 5/005 702/38 |
| 2014/0304989 | A1 | 10/2014 | Lecuyer et al. | |

* cited by examiner

APPARATUS FOR CIRCUMFERENTIAL SEPARATION OF TURBINE BLADES

BACKGROUND

The present disclosure relates generally to turbomachines, and more particularly, to increasing a circumferential separation between two blades circumferentially adjacent to a dovetail slot positioned therebetween, which may include a targeted turbine blade therein.

Rotors for turbomachines such as turbines are often machined from large forgings. Rotor wheels cut from the forgings are typically slotted to accept the roots of turbine blades for mounting. As the demand for greater turbine output and more efficient turbine performance continues to increase, larger and more articulated turbine blades are being installed in turbomachines. Latter stage turbine blades are one example in a turbine where blades are exposed to a wide range of flows, loads and strong dynamic forces. Consequently, optimizing the performance of these latter stage turbine blades in order to reduce aerodynamic losses and to improve the thermodynamic performance of the turbine can be a technical challenge.

Dynamic properties that affect the design of these latter stage turbine blades include the contour and exterior surface profile of the various blades used in a turbomachine assembly, which may affect the fluid velocity profile and/or other characteristics of operative fluids in a system. In addition to the contour of the blades, other properties such as the active length of the blades, the pitch diameter of the blades and the high operating speed of the blades in both supersonic and subsonic flow regions can significantly affect performance of a system. Damping and blade fatigue are other properties that have a role in the mechanical design of the blades and their profiles. These mechanical and dynamic response properties of the blades, as well as others, such as aero-thermodynamic properties or material selection, all influence the relationship between performance and surface profile of the turbine blades. Consequently, the profile of the latter stage turbine blades often includes a complex blade geometry for improving performance while minimizing losses over a wide range of operating conditions.

The application of complex blade geometries to turbine blades, particularly latter stage turbine blades, presents certain challenges in assembling these blades on a rotor wheel. For example, adjacent turbine blades on a rotor wheel are typically connected together by cover bands or shroud bands positioned around the outer periphery of the blades to confine a working fluid within a well-defined path and to increase the rigidity of the blades. These interlocking shrouds may impede the direct assembly and disassembly of blades positioned on the rotor wheel. In addition, inner platforms of these blades may include tied-in edges, which also can impede their assembly on the rotor wheel.

SUMMARY

A first aspect of the present disclosure provides an apparatus for circumferentially separating turbine blades, the apparatus including: a length-adjustable elongate member having opposing first and second ends; a first clasp coupled to the first end of the length-adjustable elongate member, the first clasp shaped to at least partially engage an airfoil profile of a first turbine blade positioned circumferentially adjacent to a dovetail slot, relative to a centerline axis of the turbomachine; and a second clasp coupled to the second end of the length-adjustable elongate member, the second clasp shaped to at least partially engage an airfoil profile of a second turbine blade circumferentially positioned adjacent to the dovetail slot, the first and second turbine blades being circumferentially adjacent to the dovetail slot at opposing circumferential ends thereof.

A second aspect of the present disclosure provides an apparatus for expanding a circumferential separation between a first turbine blade and a second turbine blade each positioned within a rotor wheel of a turbomachine, the apparatus including: a length-adjustable elongate member having opposing first and second ends, and configured to impart a separating force against the first and second turbine blades circumferentially outward from a targeted turbine blade of the rotor wheel, thereby increasing the circumferential separation between the targeted turbine blade and shroud portions of the first and second turbine blades; a first clasp coupled to the first end of the length-adjustable elongate member, the first clasp shaped to at least partially engage an airfoil profile of the first turbine blade proximal to the shroud portion of the first turbine blade; and a second clasp coupled to the second end of the length-adjustable elongate member, the second clasp shaped to at least partially engage an airfoil profile of the second turbine blade proximal to the shroud portion of the second turbine blade, the first and second turbine blades being separated by the targeted turbine blade positioned circumferentially therebetween.

A third aspect of the present disclosure provides an apparatus for expanding a circumferential separation between a first turbine blade and a second turbine blade each positioned within a rotor wheel of a turbomachine, wherein the first and second turbine blades are separated by a targeted turbine blade positioned circumferentially therebetween, the apparatus including: a length-adjustable elongate member having opposing first and second ends; a first clasp rotatably coupled to the first end of the length-adjustable elongate member, the first clasp shaped to at least partially engage an airfoil profile of the first turbine blade proximal to a shroud portion of the first turbine blade; and a second clasp rotatably coupled to the second end of the length-adjustable elongate member, the second clasp shaped to at least partially engage an airfoil profile of the second turbine blade proximal to a shroud portion of the second turbine blade; wherein each of the first and second clasps impart a separating force against the first and second turbine blades circumferentially outward, to expand the circumferential separation between targeted turbine blade and the shroud portions of the first and second turbine blades.

DETAILED DESCRIPTION

Spatially relative terms, such as "inner," "outer," "beneath," "below," "lower," "above," "upper," "inlet," "outlet," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 1:
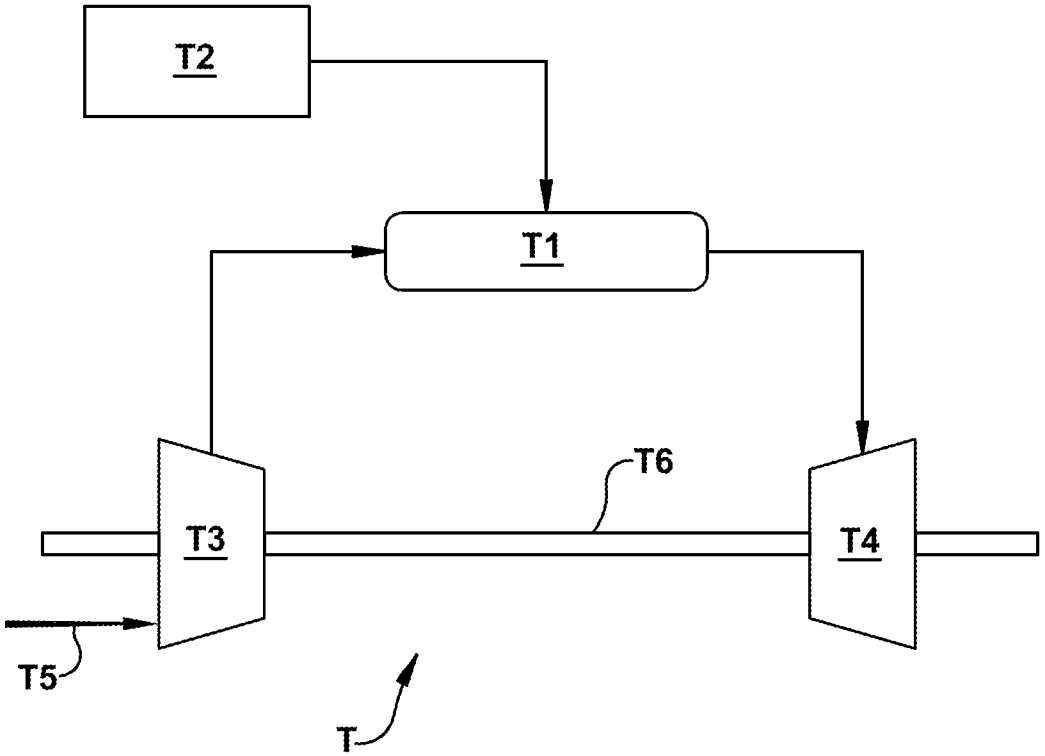
FIG. 1 (Prior Art)
FIG. 1 is an overhead view of a conventional power generation system in the form of a gas turbine.

FIG. 1 shows a schematic view of a conventional gas turbine assembly T. A gas turbine is a type of internal combustion engine in which compressed air is reacted with a fuel source to generate a stream of hot air. The hot air enters a turbine section and flows against several turbine blades to impart work against a rotatable shaft. The shaft can rotate in response to the stream of hot air, thereby creating mechanical energy for powering one or more loads (e.g., compressors and/or generators) coupled to the shaft. Combustors T1, connected to fuel nozzles T2, are typically located between compressor T3 and turbine T4 sections of gas turbine assembly T. Fuel nozzles T2 can introduce fuel into combustor T1 which reacts with compressed air yielded from compressor T3. Air T5 flows sequentially through compressor T3, combustor T1, and lastly through turbine T4. Work imparted to rotatable shaft T6 can, in part, drive compressor T3. Other forms of turbomachinery besides gas turbines (e.g., gas turbine assembly T) may feature a similar arrangement of components.

Figure 2:
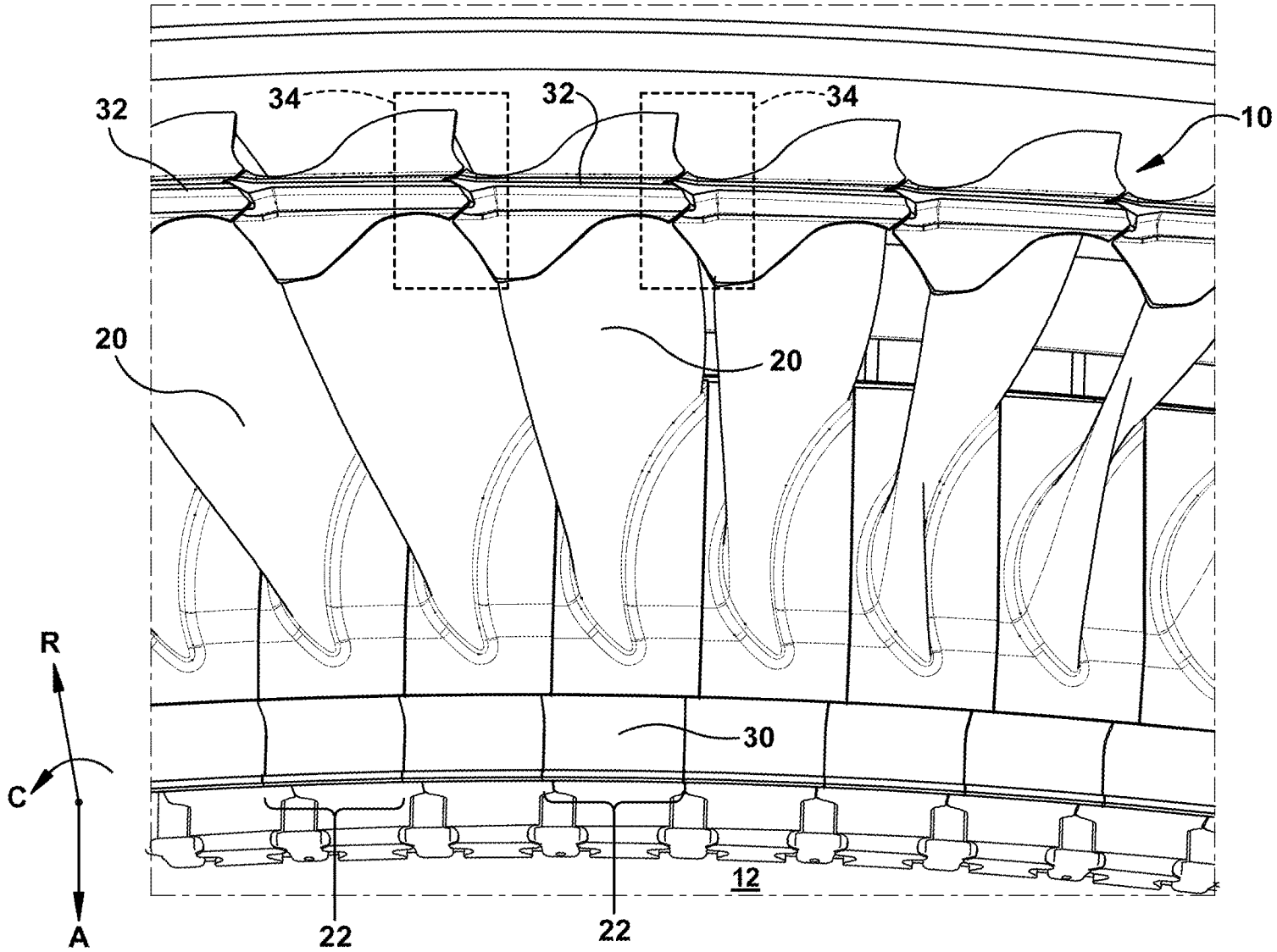
FIG. 2 is a perspective view of a rotor wheel with a set of turbine blades to be prepared for installation or removal according to embodiments of the present disclosure.

In FIG. 2, a portion of a turbomachine 10, e.g., of gas turbine assembly T (FIG. 1), is shown. Turbomachine 10 may include a rotor wheel 12, which may be positioned circumferentially about a rotor (not shown) and can have a substantially annular shape. Rotor wheel 12 is shown as being substantially oriented along an axial axis A with a radial axis R extending therefrom. Several turbine blades 20 can be coupled to rotor wheel 12 and may each extend substantially outward from axial axis A, e.g., in the same direction as radial axis R. Blades 20 are shown arranged in a row and mounted circumferentially adjacent to each other on rotor wheel 12. Blades 20 may be designed for continued circumferential engagement with each other during operation and when subjected to relatively high loads. An example form of mechanical engagement between circumferentially adjacent blades 20 is shown in FIG. 2, and embodiments of the present disclosure may be effective for preparing blades 20 for installation within or removal from this arrangement or similar arrangements.

Each blade 20 can be mechanically coupled to and mounted on rotor wheel 12 at a dovetail slot 22 of rotor wheel 12 through a turbine blade root 30. Turbine blade root 30 may include, e.g., a dovetail profile designed to fit within and engage a complementary slot within rotor wheel 12. As shown in FIG. 2, blades 20 can extend radially outward from blade root 30 with varying profiles and/or contours for accommodating a flow of fluid across each blade 20. A radial end of blade 20 opposite dovetail slot 22 can include a shroud portion 32 in the form of a mutually engaging, substantially identical block or plate formed and/or mounted on the tip of each blade 20. Once each blade 20 is installed on rotor wheel 12, the engaging blocks or plates of each shroud portion 32 can form a substantially continuous tip shroud element, e.g., a substantially continuous, annular body configured to direct a flow around rotor wheel 12.

Shroud portion 32 of each blade 20 can be shaped to include, e.g., an interlocking profile 34 for circumferential engagement with shroud portions 32 of adjacent blades 20. Interlocking profile 34 can include multiple regions of contact between directly adjacent blades 20, and such regions of contact may be oriented in an at least partially radial and/or circumferential direction relative to axial axis A. In some examples, interlocking profile 34 may include a Z-shape, a V-shape, a zig-zag path with multiple transition points, a curvilinear surface, a complex geometry including straight-faced and curved surfaces, etc. However embodied, interlocking profile 34 can inhibit axial sliding of each blade 20 relative to rotor wheel 12 after each blade 20 has been installed. These aspects of interlocking profile 34 can be advantageous during operation of turbomachine 10, e.g., by maintaining the relative position of each blade 20 relative to each other and to rotor wheel 12. However, interlocking profile 34 may also reduce the ability for one or more blades 20 to be installed or removed from a location directly between two other blades 20 during manufacture or servicing. Embodiments of the present disclosure can mitigate these properties of interlocking profile 34, e.g., by increasing the circumferential separation between two blades 20 to allow one blade 20 to be installed or removed at a portion of rotor wheel 12 positioned therebetween. Various embodiments for at least temporarily increasing a circumferential separation distance between two blade(s) 20 are discussed herein. Embodiments of the present disclosure can include an apparatus which may be operated manually and/or automatically by a user or other machine used for servicing turbomachine 10.

Figure 3:
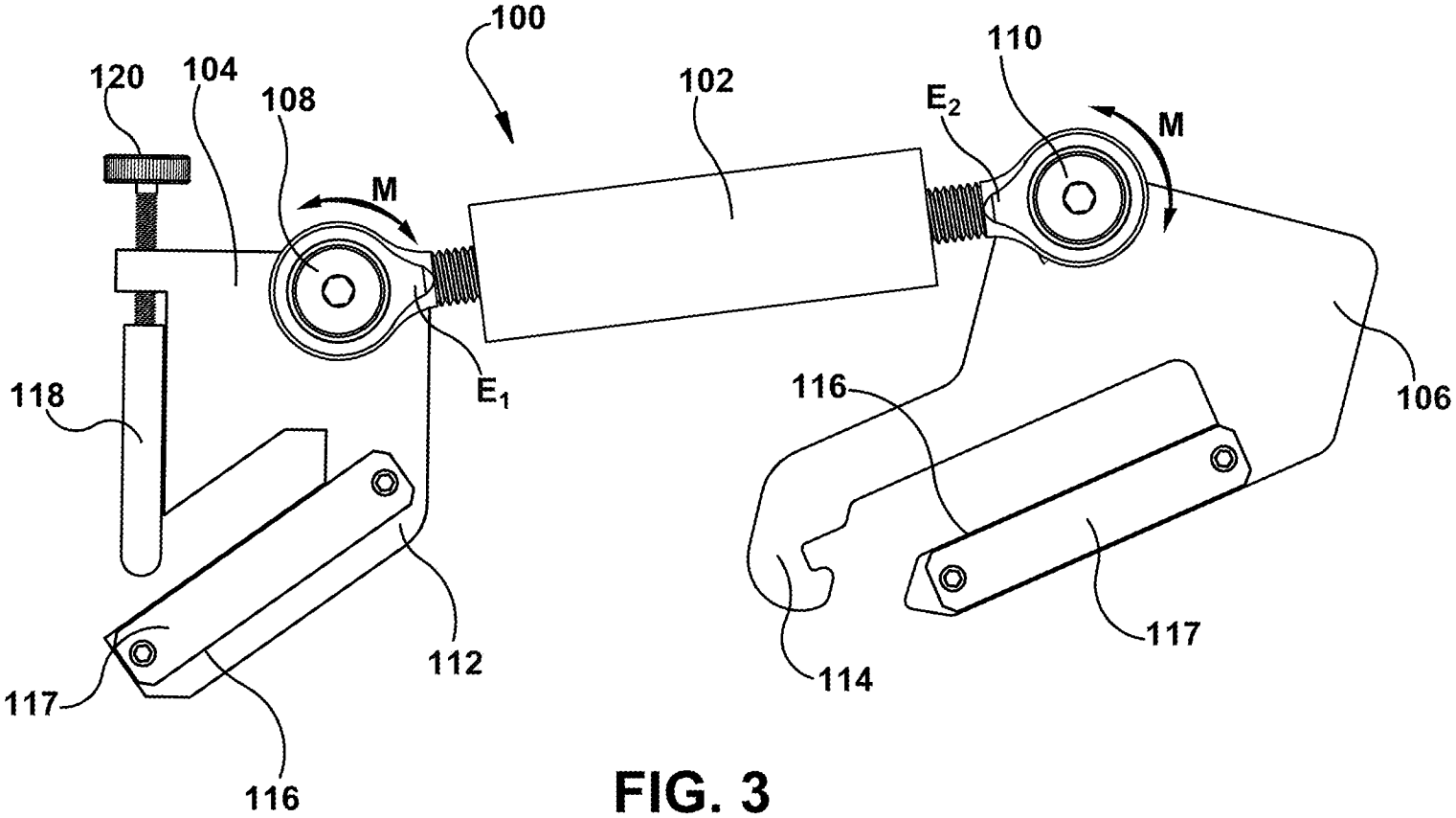
FIG. 3 is a perspective view of an apparatus according to one embodiment of the present disclosure.

Turning to FIG. 3, an apparatus 100 according to embodiments of the disclosure is shown. Apparatus 100 may be operable to expand a circumferential separation distance between two blades 20 as described herein and shown in FIGS. 5-7, separately discussed. Apparatus 100 may include a length-adjustable elongate member (simply "elongate member" hereafter) 102 with a first end $E_1$ and an opposing second end $E_2$. Elongate member 102 may be mechanically adapted to allow a user to adjust the lateral displacement between its first and second ends $E_1$, $E_2$, by way of any currently-known or later-developed instrument for adjusting the length of a component. In an example embodiment, elongate member 102 may be embodied as, or may otherwise include, a turnbuckle. A turnbuckle refers to a mechanical component configured to provide adjustable length through two threaded elements joined by a connecting portion adjustably coupled to the threaded elements. In alternative embodiments, elongate member 102 may include a telescoping member, a connected set of modular members, flexible materials adapted for providing an adjustable length (e.g., fibrous materials such as elastic), as well as combinations of these mechanisms and/or other mechanisms.

Apparatus 100 can include a first clasp 104 and a second clasp 106 each respectively coupled to opposing ends $E_1$, $E_2$, of elongate member 102. According to one example, first and second clasps 104, 106 may each be rotatably coupled to ends $E_1$, $E_2$, of elongate member 102 through a first rotatable coupler 108 and a second rotatable coupler 110. Rotatable couplers 108, 110 can allow movement of first and second clasps 104, 106 relative to elongate member 102, e.g., along the direction of arrow M. As discussed in further detail elsewhere herein, each clasp 104 can be shaped to at least partially engage an airfoil profile of blade(s) 20 (FIG. 2) in turbomachine 10 (FIG. 1). First and second clasps 104, 106 can be composed of, e.g., one or more metals, polymers, ceramics, and/or materials capable of engaging and supporting blade(s) 20. Clasps 104, 106 can include one or more flexible and/or fixed components for mechanically engaging one or more elements therein, e.g., grips, clamps, arms, recessed members, etc. First and second clasps 104, 106 may be shaped to at least partially engage an airfoil profile of blade(s) 20 as depicted in FIG. 3 and described elsewhere herein. Each clasp 104, 106 may be configured to rotate about elongate member 102 by being connected thereto through rotatable couplers 108, 110. Rotatable couplers 108, 110 can include, e.g., hinge joints, ball-and-socket joints, saddle joints, condyloid joints, pivot joints, etc.

First clasp 104 can optionally include a coupling component 112 configured to secure first clasp 104 of apparatus 100 to one blade 20. Second clasp 106 may similarly include a coupling component 114 for securing second clasp 106 of apparatus 100 to another blade 20. Each coupling component 112, 114 may be embodied as, e.g., an additional member fixedly or adjustably coupled to first or second clasp 104, 106 to increase the contact area between clasp 104, 106 and blade 20. Coupling component 112, 114 may be shaped to engage or receive therein an edge, surface, and/or distinct portion of blade 20 therein. Coupling component 112, 114 can allow a user to secure apparatus 100 to respective blades 20 during operation. In addition, a user of apparatus 100 can apply mechanical work against blades 20 through coupling components 112, 114 when operated.

One or more clasps 104, 106 of apparatus 100 may also include a radially-extending member 116 to further engage blade(s) 20 to be circumferentially separated from at least one targeted blade 20*c* therebetween. Radially-extending member 116 may be coupled to any desired portion of clasp 104, 106 to effectuate contact between radially-extending member 116 and blade 20. In an example, radially-extending member 116 can be coupled to coupling component 112, 114 of first or second clasp 104, 106. Radially-extending member 116 can, optionally, have a different material composition from its corresponding clasp 104, 106. According to an example, radially-extending member 116 may include a polymerous material, e.g., a thermoelastic polymer such as polyoxymethylene, acrylonitrile butadiene styrene, and/or similar materials. However embodied, radially-extending member 116 may have a material composition which imparts a reduced amount of mechanical stress on contacted blade(s) 20, as compared to the composition of first and second clasp(s) 104, 106. Radially-extending member 116 can further include a radial endwall 117 shaped to engage a portion of blade 20 other than a sidewall thereof. For instance, radial endwall 117 may be shaped to engage shroud portion 32 (FIG. 2) of a respective blade 20 to provide additional contact between blade 20 and apparatus 100.

First and/or second clasps 104, 106 can optionally include an axially extendable member 118 for modifying a shape of first or second clasp 104, 106, and or securing apparatus 100 at a desired position relative to blade(s) 20 (FIG. 2). Axially extendable member 118 is shown in FIG. 1 as being coupled only to first clasp 104, but FIGS. 5-7 discussed elsewhere herein show axially-extendable member 118 on first and second clasps 104, 106. In an embodiment, axially-extendable member 118 can be coupled to clasp 104, 106 distally relative to elongate member 102 through a length-adjustable coupler 120, e.g., a threaded fastener, a linearly adjustable member, a gear bearing, etc. However embodied, axially-extendable member 118 can be retracted such that first or second clasp(s) 104, 106 may contact or otherwise receive blade 20 therein. An operator may extend axially-extendable member 118 to obstruct blade 20 from separating from apparatus 100 until axially-extendable member 118 is retracted again, e.g., after targeted blades 20 have been installed or removed. When extended, axially-extendable member can modify a shape of first or second clasp 104, 106, e.g., to complement the profile of blade 20.

Figure 4:
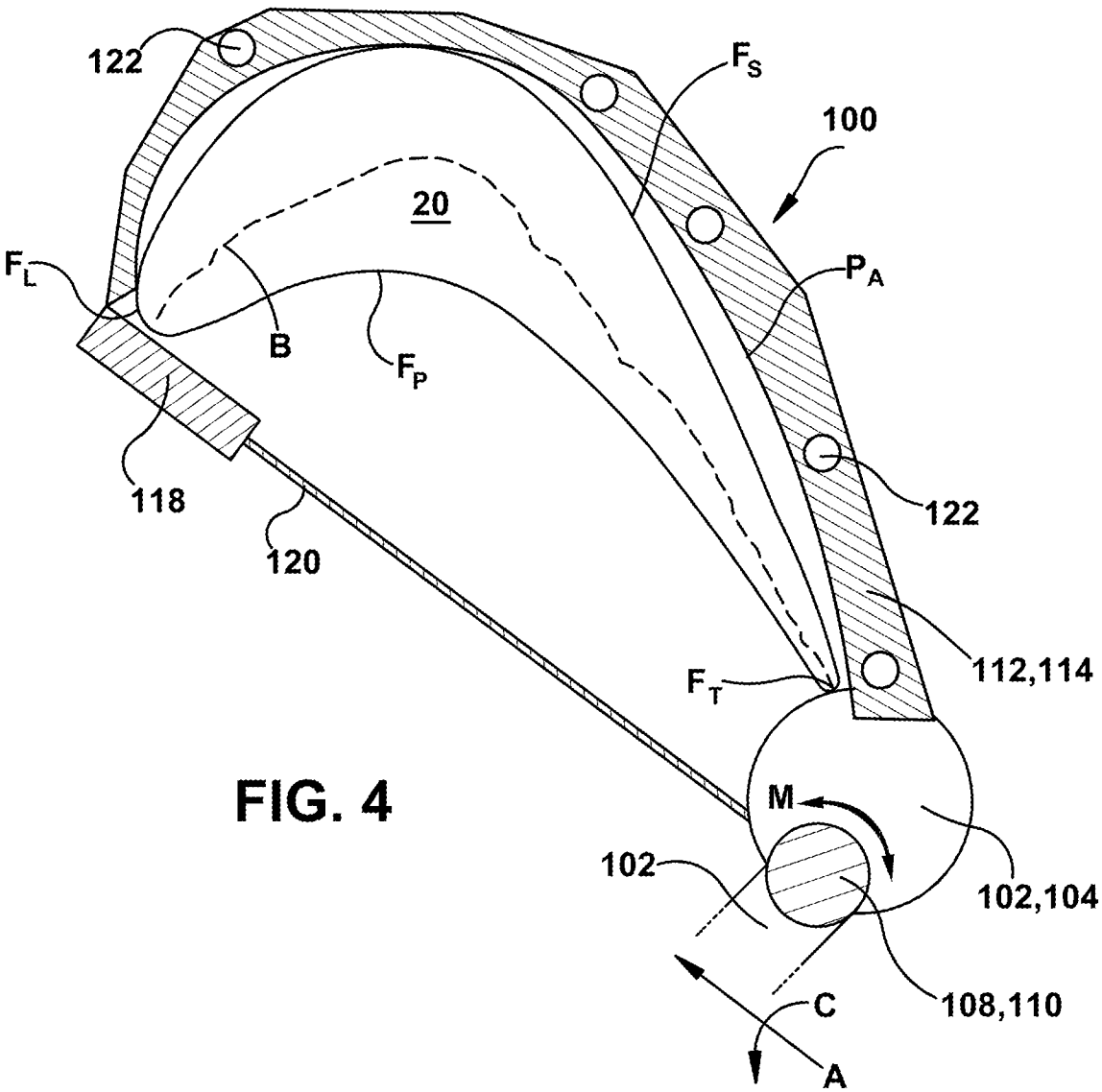
FIG. 4 is a cross-sectional view of a turbine blade and clasp according to embodiments of the present disclosure.

Turning to FIG. 4, a cross-sectional view of apparatus 100 is shown with blade 20 to demonstrate an example of contact therebetween during operation. A group of supports 122 can extend radially outward from clasp(s) 104, 106, e.g., from coupling component 112, 114 thereof to retain radially-extending member 116 (FIG. 3) thereon. The features discussed herein may be applicable to first and/or second clasps 104, 106, identified alternatively in FIG. 4 together with first and second rotatable couplings 108, 110, and first and second coupling components 112, 114.

Blade 20 can include multiple surfaces and/or points of reference described herein. The separately identified surfaces, locations, regions, etc., of blade 20 discussed herein are provided as examples and not intended to limit possible locations and/or geometries for blades 20 prepared for installation or removal by apparatus 100 according to embodiments of the present disclosure. The placement, arrangement, and orientation of various sub-components can change based on intended use and the type of power generation system in which cooling structures according to the present disclosure are used. The shape, curvatures, lengths, and/or other geometrical features of blade 20 can also vary based on the application of a particular turbomachine 10 (FIGS. 2-3). Blade 20 can be positioned circumferentially between similar or identical blades 20 of a power generation system such as turbomachine 10.

A leading edge $F_L$ of blade 20 can be positioned at an initial point of contact between an operative fluid of turbomachine 10 and blade 20. A trailing edge $F_T$, by contrast, can be positioned at the opposing side of blade 20. In addition, blade 20 can include a pressure side surface $F_P$ and/or suction side surface $F_S$ distinguished by a transverse line B which substantially bisects leading edge $F_L$ and extends to the apex of trailing edge $F_T$. Pressure side surface $F_P$ and suction side surface $F_S$ can also be distinguished from each other based on whether, during operation, fluids flowing past blade 20 exert positive or negative resultant pressures against respective surfaces against blade 20. In the example embodiment of FIG. 4, pressure side surface $F_P$ can have a substantially concave surface profile while suction side while suction side surface $F_S$ can have a substantially convex surface profile.

For ease of operation with different blades 20, apparatus 100 can include features which geometrically imitate, approximate, or otherwise physically correspond to respective surfaces of blade(s) 20 engaged with clasp(s) 104, 106, e.g., leading edge $F_L$, trailing edge $F_T$, pressure side surface $F_P$, and/or suction side surface $F_S$. Clasp(s) 104, 106 and/or their respective coupling component(s) 112, 114 can include a surface profile $P_A$ shaped to complement a corresponding region of blade 20. According to one example, surface profile $P_A$ of coupling component(s) 112, 114 may be inwardly concave to complement a convex surface profile of blade 20, e.g., suction side surface $F_S$. Other components of apparatus 100 may also be shaped to complement and/or structurally correspond to other portions of blade 20. For instance, axially-extendable member 118 can extend linearly from clasp 104, 106 along the direction of length-adjustable coupler. When extended, axially-extendable member 118 may contact a portion of blade 20 positioned distally relative to apparatus 100, e.g., leading edge $F_L$ and/or a proximal region of pressure side surface $F_P$. It is understood that the edges and/or surfaces of blade 20 contacted with portions of clasp(s) 104, 106 may vary between embodiments, and to accommodate varying implementations.

Figure 5:
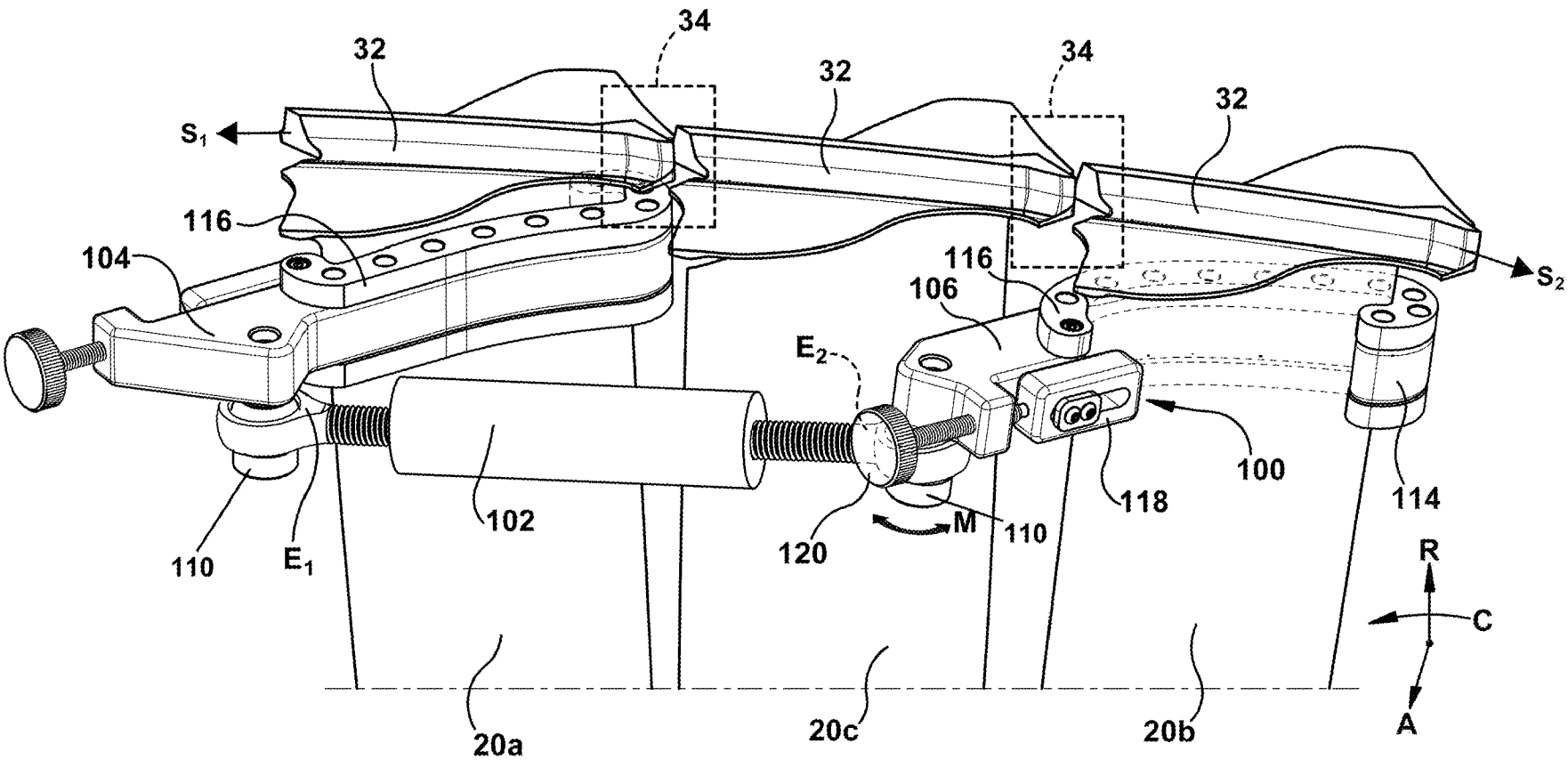
FIG. 5 is a perspective view of an apparatus and turbine blades according to embodiments of the present disclosure.

Turning to FIG. 5, a perspective view of apparatus 100 and a set of blades 20*a*, 20*b*, 20*c*, is shown to illustrate the operation of apparatus 100 and the various components discussed elsewhere herein. First clasp 104 may be shaped to engage a first blade 20*a*, while second clasp 106 may be shaped to engage a second blade 20*b*. Each clasp 104, 106 may engage blade 20*a*, 20*b* at a portion thereof radially proximal to shroud portion 32, but without contacting shroud portion 32. A targeted blade 20*c* may be positioned circumferentially between first and second blades 20*a*, 20*b*. The presence of interlocking profile 34 between circumferentially adjacent blades 20*a*, 20*b*, 20*c* may obstruct direct axial installation or removal of targeted blade 20*c*. As shown in FIG. 5, the proximity of first and second blades 20*a*, 20*b* may physically obstruct potential axial movement of targeted blade 20*c*. During operation of apparatus 100, clasps 104, 106 may engage first and second blades 20*a*, 20*b* proximal to shroud portion 32. As each blade 20*a*, 20*b* is engaged radially distally to blade root 30 (FIG. 2), a user may apply a circumferentially outward force (e.g., along the direction of arrows $S_1$, $S_2$) to separate first and second blades 20*a*, 20*b* from targeted blade 20*c*. Embodiments of the present disclosure may be operable to engage first and second blades 20*a*, 20*b* positioned circumferentially about multiple targeted blades 20*c*, e.g., three blades, five blades, ten blades, etc. Thus, although a single targeted blade 20*c* is discussed by example herein, it is understood that embodiments of the present disclosure may be operable for engaging blades 20*a*, 20*b* positioned about several targeted blades 20*c*.

Figure 6:
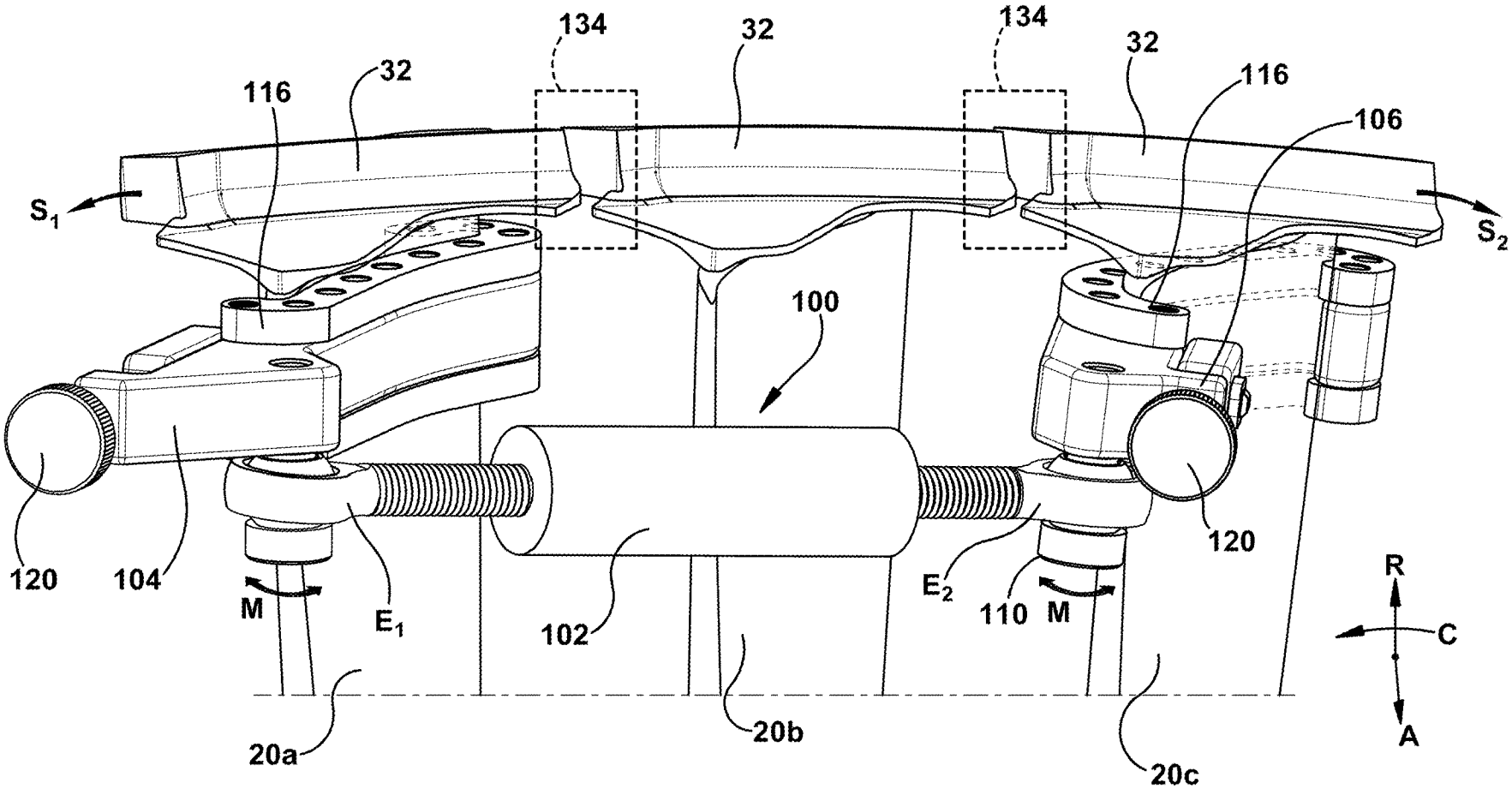
FIG. 6 is another perspective view of an apparatus and turbine blades according to embodiments of the present disclosure.
Figure 7:
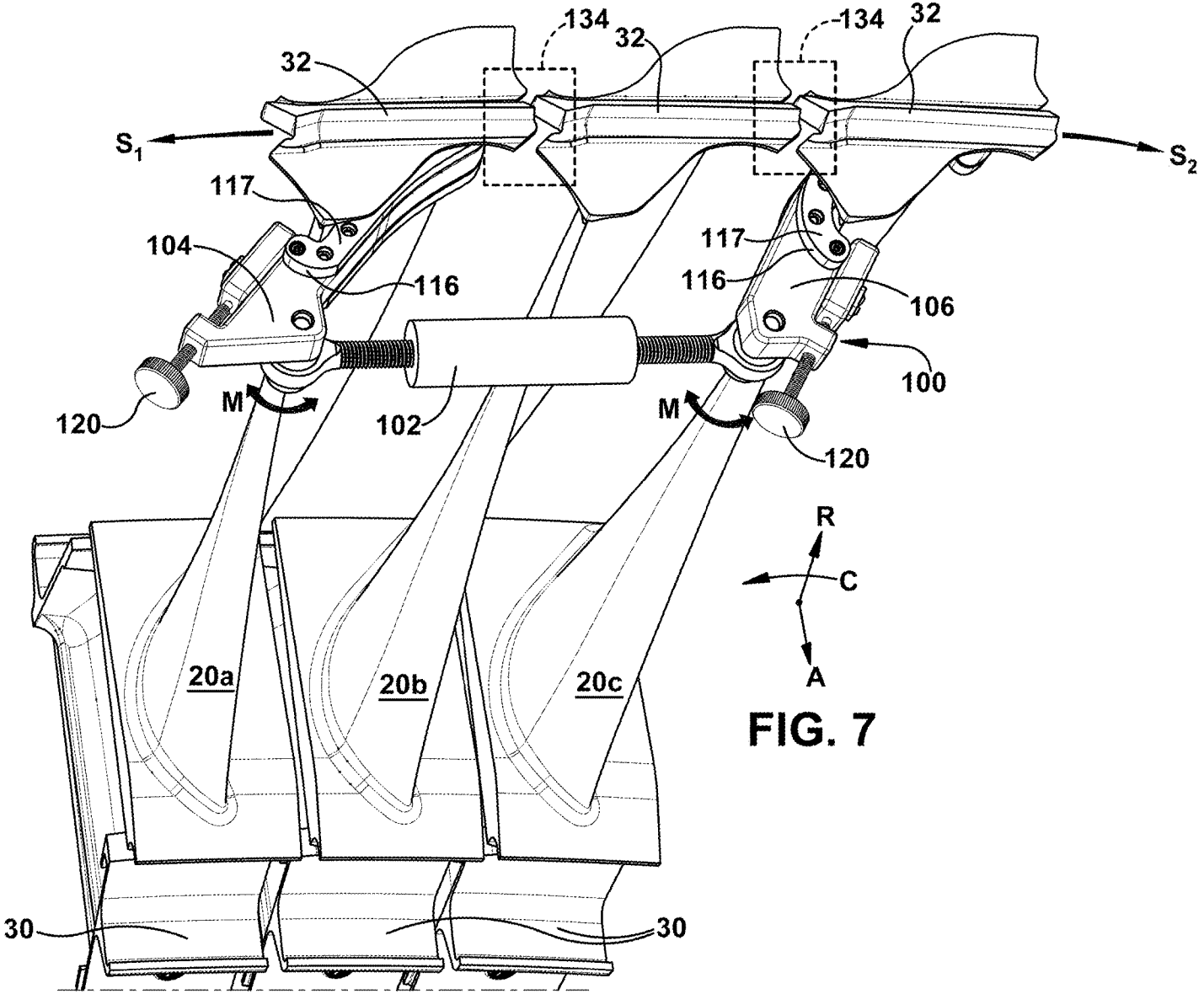
FIG. 7 is a perspective view of an apparatus being used to expand a circumferential separation between turbine blades according to embodiments of the present disclosure.

Referring to FIGS. 6 and 7 together, embodiments of apparatus 100 can expand a circumferential separation distance between first and second blades 20*a*, 20*b*, e.g., to permit axial movement of targeted blade 20*c* (e.g., for installation or removal). After clasps 104, 106 engage blades 20*a*, 20*b*, a user of apparatus 100 can optionally extend axially extendable member 118 to prevent blades 20*a*, 20*b* from being mechanically dislodged from clasps 104, 106. During engagement between apparatus 100 and blades 20*a*, 20*b*, radially-extending members 116 can physically contact radially-extending portions of blades 20*a*, 20*b*, and radial endwall 117 of radially extending members 116 may contact a radially-inward region of shroud portion 32. A user of apparatus 100 may then impart a circumferential force outwardly from targeted blade 20*c* against first and second blades 20*a*, 20*b*, e.g., substantially along the direction indicated by arrows $S_1$, $S_2$. Such movement of blades 20*a*, 20*b* can form an expanded profile 134 between targeted blade 20*c* and its circumferentially adjacent blades 20*a*, 20*b*. Expanded profile 134 can thus be formed by circumferentially imparting force against first and second blades 20*a*, 20*b* to allow axial movement of targeted blade 20*c* relative to rotor wheel 12 (FIG. 2), e.g., for installation or removal. After desired operations on targeted blade 20*c* (e.g., installing, removing, servicing, etc.) have been completed, a user can retract radially-extending members 116, dislodge clasps 104, 106 from first and second blades 20*a*, 20*b*, and/or adjust elongate member 102 to remove apparatus 100 from turbomachine 10. Apparatus 100 can thereafter be used to expand the circumferential displacement between two other turbine blades 20*a*, 20*b* and another targeted blade 20*c*.

Embodiments of the present disclosure can provide several technical and commercial settings, some of which are discussed herein by way of example. Embodiments of the fixtures and methods discussed herein can facilitate installation and removal of one or more blades without necessitating removal of all blades from a respective rotor wheel. Embodiments of the present disclosure can also prevent wear and/or other degradation of individual blades by including radially-extending members and/or other features adapted to contact less-vulnerable surfaces of each blade, and with less abrasive materials. It is also understood that embodiments of the present disclosure can provide advantages and features in other operational and/or servicing contexts not addressed specifically herein.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An apparatus for circumferentially separating turbine blades, the apparatus comprising:

a length-adjustable elongate member having opposing first and second ends;

a first clasp rotatably coupled to the first end of the length-adjustable elongate member so as to rotate about the first end of the length-adjustable elongate member, the first clasp shaped to at least partially engage an airfoil profile of a first turbine blade positioned circumferentially adjacent to a dovetail slot, relative to a centerline axis of a turbomachine including the first turbine blade; and a second clasp rotatably coupled to the second end of the length-adjustable elongate member so as to rotate about the second end of the length-adjustable elongate member, the second clasp shaped to at least partially engage an airfoil profile of a second turbine blade of the turbomachine circumferentially positioned adjacent to the dovetail slot, the first and second turbine blades being circumferentially adjacent to the dovetail slot at opposing circumferential ends thereof, wherein one of the first clasp or the second clasp includes an axially extendable member that is a coupling component configured to secure the apparatus to a respective one of the first turbine blade or the second turbine blade, each of the first and second clasps further being shaped to at least partially engage its respective turbine blade while the other of the first and second clasps at least partially engages its respective turbine blade, whereby separating the first and second turbine blades circumferentially is enabled by the first clasp being coupled to the first turbine blade while the second clasp is coupled to the second turbine blade;

wherein the axially extendable member is also configured to modify a shaft of the respective one of the first clasp or the second clasp.

2. The apparatus of claim 1, wherein the length-adjustable elongate member includes a turnbuckle configured to adjust a displacement of the length-adjustable elongate member between the opposing first and second ends thereof, and wherein one of the first clasp and the second clasp is shaped to include at least one of a concave profile, a convex profile, a leading edge profile, or a trailing edge profile.

3. The apparatus of claim 1, wherein the axially extendable member is connected to the respective one of the first clasp or the second clasp by a length-adjustable coupler attached to the respective one of the first clasp or the second clasp.

4. The apparatus of claim 1, wherein the first clasp and the second clasp are shaped to engage portions of the first turbine blade and the second turbine blade, respectively, radially proximal to a shroud portion thereof.

5. The apparatus of claim 1, wherein one of the first clasp or the second clasp includes a radially-extending member for engaging a sidewall of the first or second turbine blade.

6. The apparatus of claim 5, wherein the radially-extending member includes a radial endwall shaped to engage a shroud portion of the first or second turbine blade.

7. The apparatus of claim 5, wherein the radially-extending member includes a polymerous material.

* * * * *